United States Patent [19]

Ikeda et al.

[11] Patent Number: 4,717,650

[45] Date of Patent: Jan. 5, 1988

[54] SILVER HALIDE PHOTOGRAPHIC EMULSION

[75] Inventors: Tadashi Ikeda; Haruo Takei; Masaki Okazaki; Keizo Kimura, all of Kanagawa, Japan

[73] Assignee: Fuji Photo Film Co., Ltd., Kanagawa, Japan

[21] Appl. No.: 836,873

[22] Filed: Mar. 6, 1986

[30] Foreign Application Priority Data

Mar. 6, 1985 [JP] Japan ..... 60-44028

[51] Int. Cl.[4] ..... G03C 1/20

[52] U.S. Cl. ..... 430/494; 430/584; 430/567; 430/945

[58] Field of Search ..... 430/567, 584, 588, 945, 430/494

[56] References Cited

U.S. PATENT DOCUMENTS 3,955,996 5/1976 Hinata et al. ..... 430/584

4,046,572 9/1977 Hinata et al. ..... 430/584

*Primary Examiner*—Won H. Louie

*Attorney, Agent, or Firm*—Sughrue, Mion, Zinn, Macpeak & Seas

[57] ABSTRACT

A silver halide photographic emulsion having a high spectral-sensitivity in a red-color wavelength range, especially within a wavelength range of from 600 nm to 690 nm, is disclosed, which contains one or more sensitizing dyes represented by formula (I)

(I)

wherein $R_1$, $R_2$, $R_3$, and $R_4$ each represents an alkyl group, a substituted alkyl group, or an alkenyl group;

$V_1$, $V_2$, $V_3$, and $V_4$ each represents a hydrogen atom, a halogen atom, an alkyl group, an alkoxy group, an acyl group, an acyloxy group, an alkoxycarbonyl group, a carboxyl group, an alkoxysulfonyl group, a cyano group, or a trifluoromethyl group;

Q represents an alkyl group or an aralkyl group;

$X^{\ominus}$ represents an anion; and m is 1 or 2, provided that when the dye forms an internal salt, m is 1.

15 Claims, No Drawings

SILVER HALIDE PHOTOGRAPHIC EMULSION

FIELD OF THE INVENTION

The present invention relates to a spectrally sensitized silver halide emulsion, in particular to a silver halide photographic emulsion which has been spectrally sensitized in a red-color wavelength range.

BACKGROUND OF THE INVENTION

It has heretofore been well known in the field of manufacture of silver halide photographic emulsions to add a sensitizing dye to a silver halide emulsion for the purpose of extension of the sensitive wavelength range of the emulsion, i.e., for spectral sensitization thereof. In particular, spectral sensitization in a red-color wavelength range is important in a technique for imparting the necessary red-sensitivity to photographic materials for camera, positive photographic materials for contact papers or enlarging papers, or photographic materials for prints or in a technique for manufacture of photographic materials for printing or recording where a diode, laser, or a cathode ray tube (CRT) capable of emitting a light in a red-color wavelength range is used as a light source. Some kinds of benzimidazolo-dicarbocyanine dyes are known which may be used for the purpose of increasing the red-sensitivity of a silver halide emulsion. Examples of such dyes are described, for example, in Japanese Patent Publication Nos. 22883/68, 42495/73 and 25331/77; Japanese Patent Application (OPI) Nos. 24726/73, 4822/77 and 151026/77 (the term "OPI" as used herein refers to a "published unexamined Japanese patent application"); U.S. Pat. Nos. 3,264,110, 3,431,110, etc. However, the sensitivity is low when the benzimidazolo-dicarbocyanine dyes as described in the above patent specifications are used, and none of them has provided sufficiently desirable results. In addition, the sensitivity of these dyes lowers with the lapse of time when preserved for a long period of time, which is another problem.

In the recent years, an electronic color separation scanner with a laser ray-light source has been used in many cases in the field of printing. In particular, a neon/helium laser having a power wavelength of 632.8 nm is used in most cases. As for the spectral sensitization technique for silver halide photographic materials for formation of dot images by such a scanner-type high illumination and short period exposure, rhodacyanine dyes as described, for example, in Japanese Patent Application (OPI) Nos. 62425/75, 18726/79, and 151933/81 are known. However, some other improved spectral sensitization method is desired, which may attain a higher sensitivity to the neon/helium laser ray and which is free from any color stain due to the remaining dyes after development and fixation.

SUMMARY OF THE INVENTION

A first object of the present invention is to provide a silver halide photographic emulsion which has a high sensitivity in a red-color wavelength range, especially within a wavelength range of from 600 nm to 690 nm (preferably from 620 nm to 670 nm), and which is substantially free from any color stain due to remaining dyes.

A second object of the present invention is to provide a silver halide photographic emulsion capable of being used for a photographic material for printing or recording where a laser, diode, or CRT, having an emission spectrum in the above wavelength range is used as a light source.

A third object of the present invention is to provide a silver halide photographic emulsion which has a good preservation stability with the lapse of time, after incorporated into a photographic material.

The above objects of the present invention can be attained by the incorporation of a compound of formula (I), especially a sensitizing dye of formula (I), in a silver halide photographic emulsion.

Accordingly, the present invention provide a novel silver halide photographic emulsion containing one or more sensitizing dyes of formula (I):

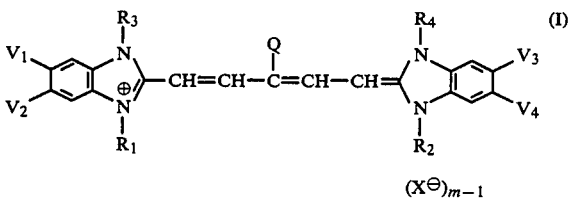

(I)

wherein $R_1$, $R_2$, $R_3$, and $R_4$ (which may be the same or different) each represents an alkyl group, a substituted alkyl group, or an alkenyl group;

$V_1$, $V_2$, $V_3$, and $V_4$ (which may be the same or different) each represents a hydrogen atom, a halogen atom, an alkyl group, an alkoxy group, and acyl group, an acyloxy group, an alkoxycarbonyl group, a carboxyl group, an alkylsulfonyl group, a cyano group, or a trifluoromethyl group;

Q represents an alkyl group or an aralkyl group;

$X^{\ominus}$ represents an anion; and m is 1 or 2, provided that when said dye forms an internal salt, m is 1.

DETAILED DESCRIPTION OF THE INVENTION

The sensitizing dyes of formula (I) which are preferably used in the present invention will be explained hereunder in more detail.

$R_1$, $R_2$, $R_3$ and $R_4$ in formula (I) (which may be the same or different) each represents an alkyl group (preferably an alkyl group having 6 or less carbon atoms, such as a methyl group, an ethyl group, a propyl group, a butyl group, and a pentyl group), a substituted alkyl group (preferably an alkyl group which has 6 or less carbon atoms and which is substituted by a substituent selected from a sulfo group, a carboxyl group, a hydroxyl group, a cyano group, an alkoxy group having 6 or less carbon atoms (such as a methoxy group and an ethoxy group), an alkoxycarbonyl group having 6 or less carbon atoms (such as a methoxycarbonyl group and an ethoxycarbonyl group), an acyloxy group having 3 or less carbon atoms (such as an acetoxy group and a propionyloxy group), an acyl group having 8 or less carbon atoms (such as an acetyl group, a propionyl group, and a benzoyl group), a carbamoyl group (such as a carbamoyl group, an N,N-dimethylcarbamoyl group, a morpholinocarbamoyl group, and a piperidinocarbamoyl group), a sulfamoyl group (such as a sulfamoyl group, an N,N-dimethylsulfamoyl group, and a morpholinosulfamoyl group), an aryl group having 10 or less carbon atoms (such as a phenyl group, a p-hydroxyphenyl group, a p-carboxyphenyl group, and a p-sulfophenyl group), a fluorine atom, and the like substituents), or an alkenyl group (such as a vinylmethyl group, a 2-butenyl group, and a 2,4-pentadienyl group).

$V_1$, $V_2$, $V_3$, and $V_4$ in formula (I) (which may be the same or different) each preferably represents a hydrogen atom, a halogen atom, an alkyl group having 6 or less carbon atoms (such as a methyl group, and an ethyl group, and a propyl group), an alkoxy group having 6 or less carbon atoms (such as a methoxy group and an ethoxy group), an acyl group having 8 or less carbon atoms (such as an acetyl group and a propionyl group), an acyloxy group having 3 or less carbon atoms (such as an actoxy group and a propionyloxy group), an alkoxycarbonyl group having 8 or less carbon atoms (such as a methoxycarbonyl group and an ethoxycarbonyl group), a carboxyl group, an alkylsulfonyl group having 5 or less carbon atoms, a cyano group, or a trifluoromethyl group.

Q in formula (I) preferably represents an alkyl group having 4 or less carbon atoms (such as a methyl group, an ethyl group, and a propyl group) or an aralkyl group having 10 or less carbon atoms, especially a phenylalkyl group (such as a benzyl group, a phenethyl group, and a phenylpropyl group).

In particular, especially preferred sensitizing dyes of formula (I) which may be used in the present invention have the following substituents:

$R_1$, $R_2$, $R_3$, and $R_4$ (which may be the same or different) each are especially preferably an alkyl group having 5 or less carbon atoms (such as a methyl group, an ethyl group, and a propyl group); an alkyl group having 4 or less carbon atoms substituted with a sulfo group, a carboxyl group or a hydroxyl group; an alkyl group having 3 or less carbon atoms substituted with a p-sulfophenyl group, a p-carboxyphenyl group or a p-hydroxyphenyl group; or an alkyl group having 6 or less carbon atoms substituted with a fluorine atom.

$V_1$, $V_2$, $V_3$, and $V_4$ (which may be the same or different) each are especially preferably a hydrogen atom, a halogen atom, an acyloxy group having 3 or less carbon atoms (such as an acetoxy group and a propionyloxy group), an alkoxycarbonyl group having 4 or less carbon atoms (such as a methoxycarbonyl group and an ethoxycarbonyl group), a cyano group, or a trifluoromethyl group.

Q is especially preferably a methyl group, an ethyl group, a propyl group, or a benzyl group.

Of the sensitizing dyes of formula (I), those wherein two or more of $V_1$ to $V_4$ represent chlorine atoms and one or more of $V_1$ to $V_4$ represent a cyano group or a trifluoromethyl group, and those wherein one or more of $R_1$ and $R_2$ represent a sulfoalkyl group, and one or more of $R_1$ to $R_4$ represent a fluorine-substituted alkyl group are particularly preferred.

Examples of the sensitizing dyes of formula (I) which may be used in the present invention are set forth below, which, however, does not whatsoever restrict the scope of the present invention.

EXAMPLES OF COMPOUNDS OF FORMULA (I)

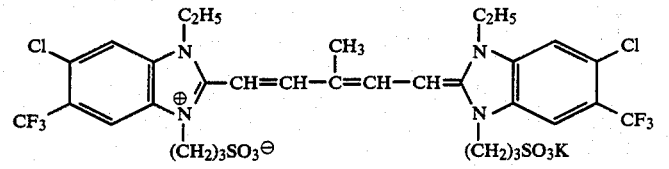

(1)

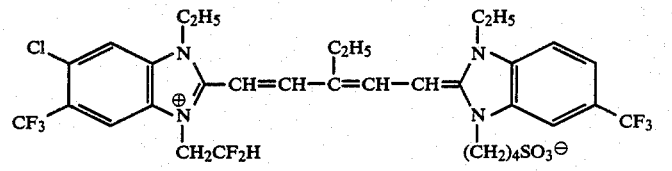

(2)

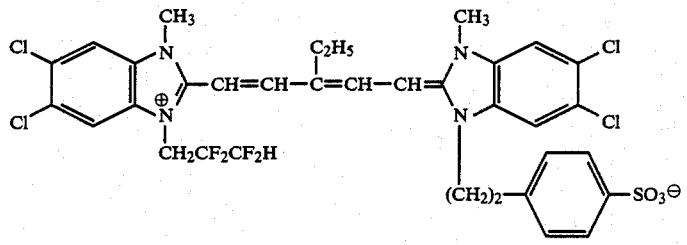

(3)

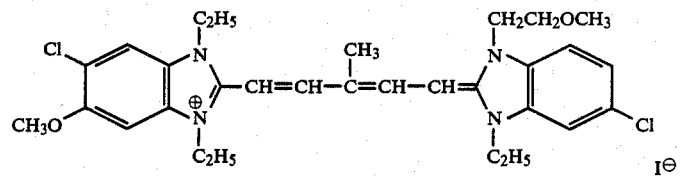

(4)

-continued
(5)
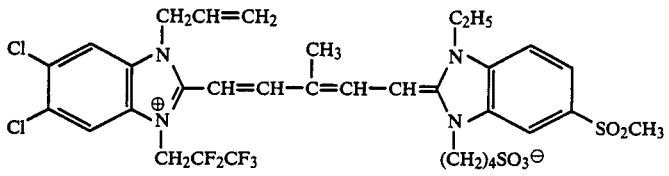
(6)
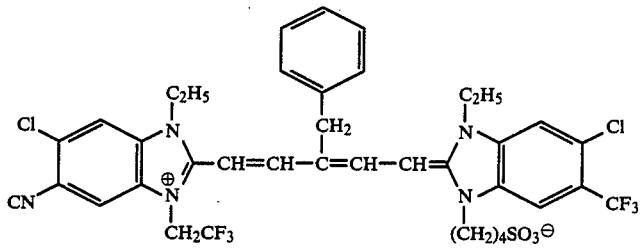
(7)
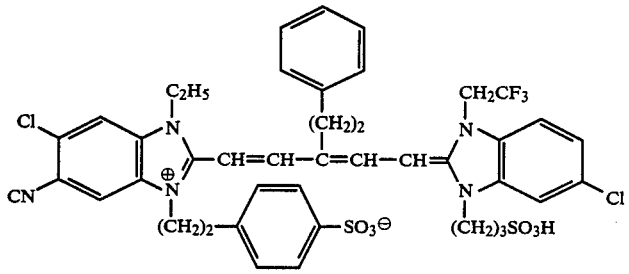
(8)
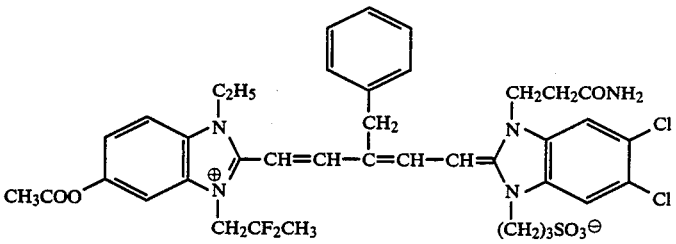
(9)
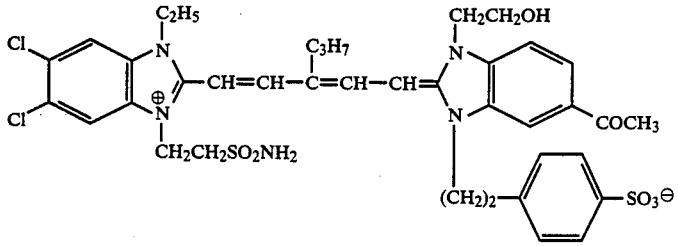
(10)
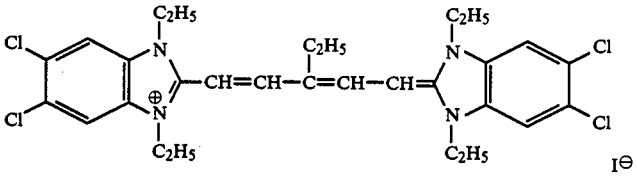
(11)
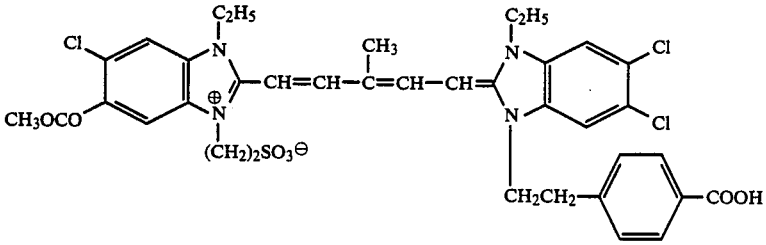

-continued
(12)
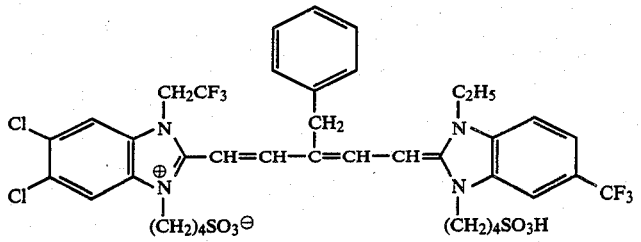
(13)
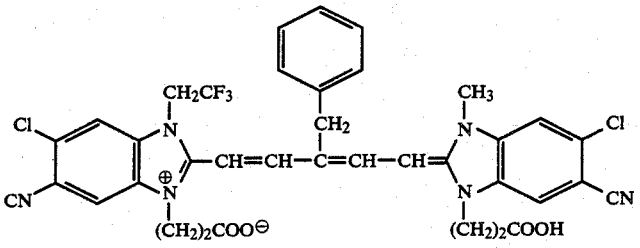
(14)
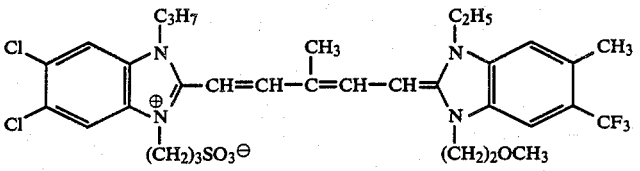
(15)
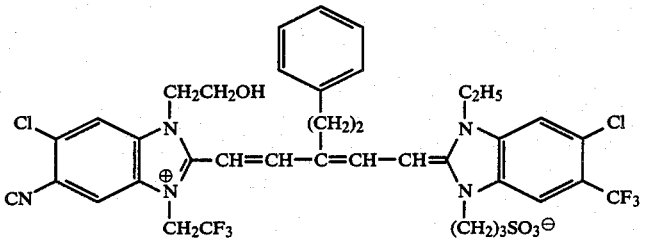
(16)
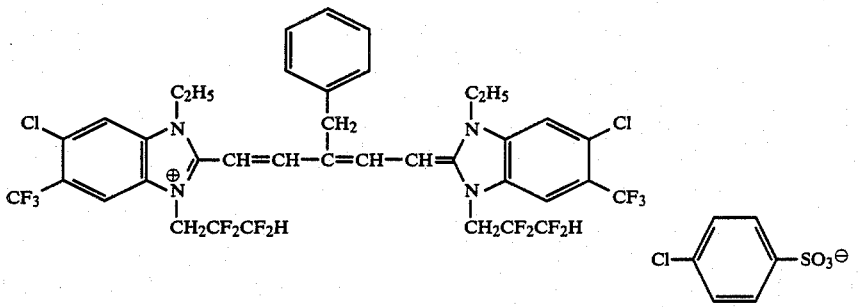
(17)
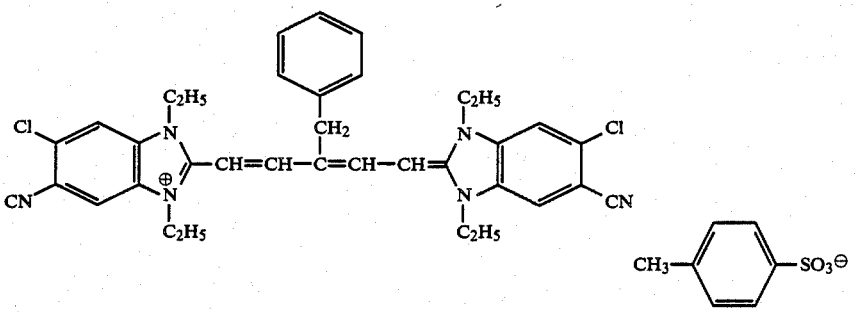

-continued (18)

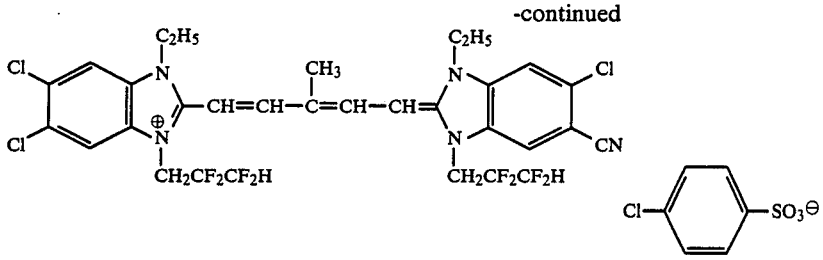

(19)

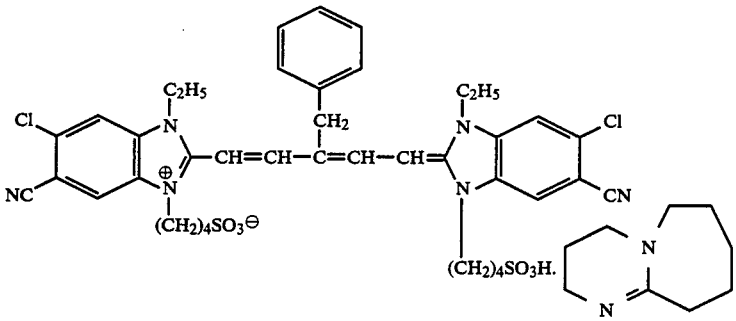

The above-described sensitizing dyes to be used in the present invention may be synthesized in accordance with known methods as described, for example, in *Heterocyclic Compounds,* "Cyanine Dyes and Related Compounds" by F. M. Hamer, Chap. 5, pp. 116–147 (published by John Wiley & Sons Co., New York, London, in 1964) and *Heterocyclic Compounds,* "Special Topics in Heterocyclic Chemistry" by D. M. Sturmer, Chap. 8, Sec. 4, pp. 482–515 (published by John Wiley & Sons Co., New York, London, in 1977).

An example for synthesis of a sensitizing dye falling with the scope of formula (I), which may be used in the present invention, is set forth below.

SYNTHESIS OF COMPOUND NO. (19)

4.27 g (12 mmoles) of 4-(5-chloro-6-cyano-3-ethyl-2-methylbenzimidazolio-1)-butane sulfonate and 11.2 g (36 mmoles) of 2-benzyl-1,1,3,3-tetraethoxypropane, and in addition, 5 ml of acetic anhydride and 7 ml of m-cresol were placed in a 100 ml-three neck flask with a thermometer and a stirrer. The mixture was heated at 150° C. with an oil bath for 2 hours. The reaction mixture is cooled with an ice, and then, 8 ml of 1,8-diazabicyclo[5,4,0]-7-undecene was added dropwise thereto. After the whole was stirred for 10 minutes while cooled with an ice, the precipitated crystal was taken out by filtration and washed with acetonitrile. The thus-obtained crude crystal was repeatedly purified with methanol and ethanol (i.e. by dissolving in methanol, adding ethanol thereto and concentrating the resulting solution to precipitate the crystal therefrom under atmospheric pressure), to finally obtain 7.2 g of a pure product of compound No. (19).

$\lambda_{max}^{MeOH}=624$ nm ($\epsilon=2.49\times10^5$)

The other compounds may also be synthesized in the same manner.

The sensitizing dye represented by formula (I) is incorporated in a silver halide photographic emulsion in an amount sufficient to spectrally sensitize the photographic emulsion, and for example, the amount of the sensitizing dye to be incorporated in the emulsion is generally from $5\times10^{-7}$ mole to $5\times10^{-3}$ mole, preferably from $5\times10^{-6}$ mole to $2\times10^{-3}$ mole, and more preferably from $1\times10^{-5}$ mole to $1\times10^{-3}$ mole, per mole of silver halide contained in the emulsion.

The sensitizing dye to be used in the present invention may directly be dispersed in an emulsion. Otherwise, the sensitizing dye of the present invention may first be dissolved in an appropriate solvent, for example, methyl alcohol, ethyl alcohol, propyl alcohol, methylcellosolve, a halogenated alcohol as described in Japanese Patent Application (OPI) No. 9715/73 or U.S. Pat. No. 3,756,830, acetone, water or pyridine or a mixture solvent thereof, and the resulting solution may be added to an emulsion. In addition, some other methods as described in Japanese Patent Publication, No. 24185/71 or U.S. Pat. Nos. 3,822,135, 3,660,101, 2,912,343, 2,996,287, 3,429,835, 3,469,987, 3,658,546, and 3,822,135 may also be used for the addition of the present sensitizing dye in an emulsion. Moreover, a method as described in German Patent Application (OLS) No. 2,104,283 and a method as described in U.S. Pat. No. 3,649,286 may also be used.

The sensitizing dye may be uniformly dispersed in a silver halide emulsion, before being coated on an appropriate support, and it is of course that the sensitizing dye may be added to the silver halide emulsion in any stage of the procedure for formation of the emulsion.

The photographic emulsion of the present invention may contain any of silver bromide, silver bromiodide, silver bromochloroiodide, silver bromochloride and silver chloride as a silver halide component. Preferred silver halides among them are silver bromide, silver bromochloride, silver bromoiodide, and silver bromochloroiodide.

The silver halide particles to be contained in the photographic emulsion of the present invention may have a regular crystalline form or may have an irregular crystalline form such as a spherical form or a place-like form, or otherwise may have a composite-crystalline form comprising a mixture of the regular and irregular crystalline forms. The emulsion may comprise a mixture of silver halide particles of various crystalline forms.

The silver halide to be used in the photographic emulsion of the present invention may comprise plate-like particles in which 50% or more of the total projected area comprises such particles as having a thickness of 0.5 μm or less, preferably 0.3 μm or less, a diameter of 0.6 μm or more and an average aspect ratio of 5 or more. In addition, the silver halide emulsion of the present invention may be a mono-disperse emulsion in which 95% or more particles have a particle size falling within the scope of the average particle size ±40%. Preferred silver halide crystals have a surface of [1,0,0]. In particular, silver halide particles having crystals in which the surface area ratio of the surface [1,0,0] to the total surface area of the particles is 50% or more, especially 80% or more, are especially preferred in the present invention. The determination of the crystal appearance or crystal habit of silver halide particles, or that is, the surface area ratio of the surface [1,0,0] to the total surface area of particles, may be carried out in accordance with "Determination of Crystal Appearance of Silver Halide Fine Particles in Photographic Emulsion by Utilization of Dye-Adsorption Phenomenon" (written by Tadaaki Tani) in *Reports of Japan Chemical Society* (1984), (6), pp. 942–947.

The silver halide particles to be used in the present invention may comprise different inner and outer surface crystal constitutions or may comprise a uniform crystal constitution. In addition, the particles may be those capable of forming a latent image mainly on the surface part thereof (for example, a negative type-emulsion), or alternatively those capable of forming a latent image mainly in the inner part of the particles (for example, an inner latent image-type emulsion or a previously fogged direct reversal emulsion).

The photographic emulsions to be used in the present invention may be prepared by various methods, for example, as described in *Chimie et Physique Photographique,* (by P. Glafkides, published by Paul Montel Co., 1967; *Photographic Emulsion Chemistry,* by G. F. Duffin, published by The Focal Press Co., 1966; *Making and Coating Photographic Emulsion,* by V. L. Zelikmar, et al., published by The Focal Press Co., 1964, etc. For instance, any of an acid method, a neutral method, an ammonia method, etc., may be used, and in addition, a one-side mixture method, a simultaneous mixture method or a combination thereof may be used for the reaction of a soluble silver salt and a soluble silver halide.

A so-called reverse mixture method in which silver halide particles are formed in the presence of an excess silver ion may also be used. In addition, a so-called controlled-double-jet method, which is one type of a simultaneous mixture method, may also be used, where the pAg value in the liquid to form silver halide particles is kept constant. According to this method, an emulsion containing silver halide particles having a regular crystalline form and a uniform particle size may be obtained.

Two or more kinds of silver halide emulsions which have been separately prepared may be blended and used in the present invention.

In the formation of silver halide particles, a silver halide solvent may be used for the purpose of controlling the growth of the particles, such as ammonia, potassium rhodanide, antimony rhodanide, thioether compounds (as described in U.S. Pat. Nos. 3,271,157, 3,574,628, 3,704,130, 4,297,439, and 4,276,374), thione compounds (as described in Japanese Patent Application (OPI) Nos. 144319/78, 82408/78, and 77737/80) and amine compounds (as described in Japanese Patent Application (OPI) No. 100717/79).

In any step of the formation of silver halide particles or the physical ripening thereof, a cadmium salt, a zinc salt, a thallium salt, an iridium salt or a complex salt thereof, a rhodium salt or a complex salt thereof, or an iron salt or a complex salt thereof may be co-used.

Examples of internal latent image-type emulsions which may be used in the present invention include, for example, conversion-type emulsions, core/shell-type emulsions or hetero-metal-incorporated emulsions, as described, for example, in U.S. Pat. Nos. 2,592,250, 3,206,313, 3,447,927, 3,761,276, and 3,935,014.

The silver halide emulsions of the present invention are generally chemical-sensitized. For the chemical-sensitization, a known method may be used, for example, as described in *Die Grundlagender Photographischen Prozesse mit Silver-halogeniden* (edited by H. Frieser, published by Akademische Verlagsgesellschaft, in 1968), pp. 675–734.

For instance, various known methods may be used, including a sulfur-sensitization method in which an active gelatin or a sulfur-containing compound capable of reacting with silver (such as a thiosulfate, a thiourea, a mercapto compound, a rhodanine compound) is used; a reduction-sensitization method in which a reducing substance (such as a stannous salt, an amine compound, a hydrazine derivative, a formamidine-sulfinic acid, a silane compound) is used; and a noble metal-sensitization method in which a noble metal compound (such as a gold complex or a Pt-, Rh-, Ir-, Pd- or other VIII group metal-complex) is used. The sensitization method may be used singly or in combination thereof.

The sensitization methods are concretely described in various patent specifications; for example, U.S. Pat. Nos. 1,574,944, 2,410,689, 2,278,947, 2,728,668, and 3,656,955 describe a sulfur-sensitization method; U.S. Pat. Nos. 2,983,609, 2,419,974, and 4,054,458 describe a reduction-sensitization method; and U.S. Pat. Nos. 2,399,083 and 2,448,060 and British Pat. No. 618,061 describe a noble metal-sensitization method.

Examples of chemical sensitizers are sulfur-sensitizers such as allyl thiocarbamide, thiourea, sodium thiosulfate, or cystine; noble metal sensitizers such as potassium chloro-aurate, aurous thiosulfate, or potassium chloro-palladate; and reducing sensitizers such as tin chloride, phenylhydrazine, or reductone. In addition, some other sensitizers may also be used in the sensitization methods, such as polyoxyethylene compounds, polyoxypropylene compounds, or quaternary ammonium group-containing compounds.

Various kinds of compounds may be incorporated in the photographic emulsions to be used in the present invention, for the purpose of prevention of fog or for the purpose of stabilization of photographic characteristics of photographic materials during the formation, preservation of photographic treatment of the materials. For instance, various kinds of known fog-inhibitors or stabilizers may be used therefor, including azoles such as benzothiazolium salts, nitroindazoles, triazoles, benzotriazoles, benzimidazoles (especially nitro- or halogen-substituted derivatives); heterocyclic mercapto compounds such as mercapto-thiazoles, mercapto-benzothiazoles, mercapto-benzimidazoles, mercapto-thiadiazoles, mercapto-tetrazoles (especially 1-phenyl-5-mercapto-tetrazole), mercapto-pyrimidines; the above heterocyclic mercapto compounds having a water-soluble substituent such as a carboxyl group or a sulfone group; thioketo compounds such as oxazolinethiones; azaindene compounds such as tetrazaindene compounds (especially 4-hydroxy-substituted-(1,3,3a,7)-tetrazaindene compounds); benzenethiosulfonic acids; benzenesulfinic acid, etc.

The silver halide emulsions of the present invention may further contain a polymer latex comprising a homo- or co-polymer of an alkyl acrylate, an alkyl methacrylate, acrylic acid and/or glycidyl acrylate, as described, for example, in U.S. Pat. Nos. 3,411,911, 3,411,912, 3,142,568, 3,325,286, and 3,547,650 and Japanese Patent Publication No. 5331/70 for the purpose of improving the dimensional stability of the photographic materials or improving the filming property thereof.

In case the silver halide emulsions of the present invention are used in a lith-type photographic material for printing, a polyalkylene oxide compound capable of increasing the infectious development effect of the material may be incorporated in the present emulsions. For instance, compounds as described, for example, in U.S. Pat. Nos. 2,400,532, 3,294,537, and 3,294,540; French Pat. Nos. 1,491,805 and 1,596,673; Japanese Patent Publication No. 23466/65; Japanese Patent Application (OPI) Nos. 156423/75, 18726/79, and 151933/81, etc., may be used for the purpose. Preferred examples include a condensation product of a polyalkylene oxide comprising at least ten units of an alkylene oxide having from 2 to 4 carbon atoms such as ethylene oxide, propylene-1,2 oxide or butylene-1,2 oxide, especially preferably ethylene oxide, and a compound having at least one active hydrogen atom such as water, an aliphatic alcohol, an aromatic alcohol, a fatty acid, an organic amine or a hexitol derivative; and a block-copolymer comprising two or more polyalkelene oxides. Examples of the polyalkylene oxide compounds which are preferably used are polyalkylene glycol alkyl ethers, polyalkylene glycol aryl ethers, polyalkylene glycol alkyl aryl ethers, polyalkylene glycol esters, polyalkylene glycol fatty acid amides, polyalkylene glycol amines, polyalkylene glycol block copolymers, polyalkylene glycol graft polymers, etc. The polyalkylene oxide compounds which are generally used in the present invention are those having a molecular weight of from 300 to 15,000, and preferably from 600 to 8,000. The amount of polyalkylene oxide compound to be added to the present emulsion is preferably from 10 mg to 3 g, per mole of silver halide contained therein. The polyalkylene oxide compound may be added to the emulsion in any time during the formation thereof.

The silver halide photographic emulsions of the present invention may contain a color coupler such as a cyan coupler, a magenta coupler, or a yellow coupler, and a compound capable of dispersing a coupler.

For instance, a compound capable of coloring in color development treatment by oxidation-coupling with an aromatic primary amine developing agent (such as a phenylenediamine derivative or an aminophenol derivative) may be incorporated in the present silver halide emulsions. Examples of magenta couplers are 5-pyrazolone couplers, pyrazolobenzimidazole couplers, cyanoacetylcoumarone couplers, ring-opened acylacetonitrile couplers, etc; examples of yellow couplers are acylacetamide couplers (such as benzoylacetanilides, pivaloylacetanilides), etc; and examples of cyan couplers are naphtol couplers, phenol couplers, etc. These couplers preferably are non-diffusive, having a hydrophobic group of a so-calleed ballast group in the molecule. Couplers may be either tetra-equivalent or di-equivalent to the silver ion. In addition, colored couplers having an activity for color correction or some other couplers capable of releasing a development-inhibitor during development (so-called DIR couplers) may also be used in the present invention.

In addition to the DIR couplers, a non-coloring DIR-coupling compound capable of releasing a development-inhibitor, which, however, forms a colorless product in coupling-reaction, may also be used.

The silver halide photographic emulsions of the present invention may contain a water-soluble dye (such as an oxonol dye, a hemioxonol dye or a mercocyanine dye) as a filter-dye or for the purpose of irradiation-prevention or for some other various purposes.

The photographic emulsions of the present invention may further contain various kinds of surfactants for the purpose of coating assistance, static charge-prevention, improvement of slide property, emulsification and dispersion, block-prevention and improvement of photographic characteristics (such as development acceleration, high contrast enhancement, and sensitization).

For instance, surfactanta which may be used in the present invention include non-ionic surfactants such as saponins (steroid-type), alkylene-oxide derivatives (e.g., polyethylene glycol, polyethylene glycol alkyl ethers), glycidol derivatives, fatty acid esters of polyhydric alcohols, alkyl esters of saccharides, etc.; ampholytic surfactants such as alkyl carboxylates, alkyl sulfonates, alkyl benzenesulfonates, alkyl sulfates, etc.; and cationic surfactants such as alkylamine salts, aliphatic or aromatic quaternary ammonium salts, heterocyclic quaternary ammonium salts (e.g. pyridinium or imidazolium compounds), etc.

In the present invention, known color-deterioration inhibitors may be used, and the color image-stabilizer may be used singly or in the form of a mixture of two or more thereof. Examples of known color-deterioration inhibitors which may be used in the present invention are hydroquinone derivatives, gallic acid derivatives, p-alkoxyphenols, p-oxyphenol derivatives, and bisphenols.

The photographic emulsions of the present invention may contain an inorganic or organic hardener. For instance, a chromium salt (such as chromium alum, chromium acetate), an aldehyde compound (such as formaldehyde, glyoxal, glutaraldehyde), an active vinyl compound (such as 1,3,5-triacryloyl-hexahydro-s-triazine, 1,3-vinylsulfonyl-2-propanol) or an active halogen compound (such as 2,4-dichloro-6-hydroxy-s-triazine) may be used as a hardener, singly or in the form of a mixture of two or more thereof.

Photographic materials to be prepared by using the photographic emulsions of the present invention may contain a color-fog inhibitor such as a hydroquinone derivative, an aminophenol derivative, a gallic acid derivative or an ascorbic acid derivative.

The silver halide photographic emulsions of the present invention may contain, as a protective colloid and in addition to gelatin, an acylated gelatin such as phthalated gelatin or malonated gelatin; a cellulose compound such as hydroxyethyl cellulose or carboxymethyl cellulose; a soluble starch such as dextrin; a hydrophilic polymer such as polyvinyl alcohol, polyvinyl pyrrolidone, polyacrylamide or polystyrene sulfonic acid; a plasticizer for dimension-stabilization; or a latex polymer or a matting agent. The finished emulsion of the present invention is coated on an appropriate support, such as a baryta paper, a resin-coated paper, a synthetic paper, a triacetate film, a polyethylene terephthalate film or other plastic base or glass plate.

Exposure for formation of a photographic image on a photographic material may be carried out in a conventional manner. For instance, any and every known light source may be used therefor, including natural light (sun light), a tungsten lamp, a fluorescent lamp, a mercury lamp, a xenon-arc lamp, a carbon-arc lamp, a xenon-flash lamp, a cathode-ray flying spot, etc. Regarding the exposure time, the present photographic material may be subjected not only to a general exposure in a camera of from 1/1000 sec. to 1 sec., but also to a shorter exposure than for 1/1000 sec., for example, by a xenon-flash lamp for from $1/10^4$ to $1/10^6$ sec., or to an exposure longer than 1 sec. If desired, the spectral energy distribution of the light to be used for the exposure may appropriately be regulated by the use of a color filter. A laser ray may be used for the exposure. In addition, the photographic material may be exposed to a light emitted by a fluorescent substance as excited by an electronic ray, an X-ray, a $\gamma$-ray or an $\alpha$-ray.

The spectral-sensitizing dyes of the present invention may be used for sensitization of silver halide photographic emulsions for various kinds of color or black-and-white photographic materials. Various kinds of emulsions may be used therefor, for example, including an emulsion for a color-positive film, an emulsion for a color paper, an emulsion for a color-negative film, an emulsion for a color reversal film (containing or not containing a coupler), an emulsion for a photographic material to be used in a photomechanical process (such as a lith film), an emulsion for a cathode-ray display photographic material, an emulsion to be used in a colloid transfer process (e.g., as described in U.S. Pat. No. 2,716,059), an emulsion to be used in a silver salt diffusion transfer process, an emulsion to be used in a color diffusion transfer process, an emulsion to be used in an imbibition transfer process (e.g., as described in U.S. Pat. No. 2,882,156), an emulsion to be used in a silver dye-bleaching method, an emulsion to be used in a photographic material for recording a print-out image e.g., as described in U.S. Pat. No. 2,369,449), an emulsion to be used in a direct print image-photographic material (e.g., as described in U.S. Pat. No. 3,033,682), an emulsion to be used in a heat-developing photographic material, an emulsion to be used in a physical-developing photographic material (e.g., as described in British Pat. No. 920,277), etc.

For photographic treatment of the photographic materials obtained according to the present invention, any conventional means and conventional known treating solution may be utilized, e.g., as described in *Research Disclosure,* RD No. 17643, Vol. 176, December, 1978, pp. 28–30. The photographic treatment may be any of a treatment for formation of a silver image (black-and-white photographic treatment) or a treatment for formation of a color image (color photographic treatment), in accordance with the object and the use of the photographic materials to be treated. The treatment temperature is generally selected from the range of 18° C. to 50° C., or as the case may be, the temperature may be lower than 18° C. or higher than 50° C.

The present invention will be explained in greater detail by reference to the following examples, which, however, are not intended to be interpreted as limiting the scope of the present invention.

EXAMPLE 1

A sulfur-sensitized silver halide emulsion was prepared, comprising 70 mole% of silver chloride, 29.5 mole% of silver bromide and 0.5 mole% of silver iodide. The silver halide particles contained in the emulsion had an average grain diameter of 0.35 $\mu$m. 1 kg of the emulsion contained 1.03 moles of silver halides.

1 kg each of the emulsion was put in a pot, and a sensitizing dye (of the present invention or of a comparative dye, as shown in the following Tables 1 to 3) was added thereto and blended and stirred at 40° C. Next, 4-hydroxy-6-methyl-1,3,3a,7-tetrazaindene (in an amount of 0.2 g/kg (emulsion)), sodium 1-hydroxy-3,5-dichlorotriazine (in an amount of 0.1 g/kg (emulsion)) and sodium dodecylbenzenesulfonate (in an amount of 0.1 g/kg (emulsion)) were added to the resulting mixture in this order, and the thus formed coating solution was coated on a polyethylene terephthalate film base to obtain a photographic material.

Each of the thus-obtained samples was exposed to a tungsten light (2854° K.) for 5 seconds through a red-color filter of SC-60 (made by Fuji Photo Film Co.) which transmits a light having a wavelength longer than 600 nm.

After the exposure, each sample was developed in a developer having the following composition at 20° C. for 2 minutes. The density of each sample was measured with a densitometer (made by Fuji Photo Film Co.), to obtain a red-filter sensitivity (SR) and a fog in each of the developed samples. The standard point of the optical density for the determination of the sensitivity was a point of "fog+1.5".

COMPOSITION OF DEVELOPER:

| | |
|---|---|
| Water | 700 ml |
| Metol | 3.1 g |
| Anhydrous sodium sulfite | 45 g |
| Hydroquinone | 12 g |
| Sodium carbonate (monohydrate) | 79 g |
| Potassium bromide | 1.9 g |
| Water to make | 1 liter |

In actual use, two time (by volume) of water were added, and the diluted solution was used as a developer solution.

Results (in terms of relative values) are given in the following Tables 1 to 3 (taking the sensitivities of Sample Nos. 7, 15 and 23, respectively, as being 100), which show that all the samples containing the present sensitizing dyes have higher sensitivity and less fog over the other comparative samples.

CHEMICAL STRUCTURAL FORMULAE OF COMPARATIVE DYES

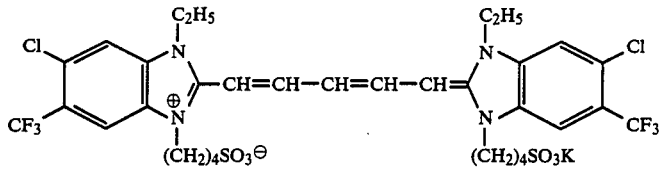

(A)

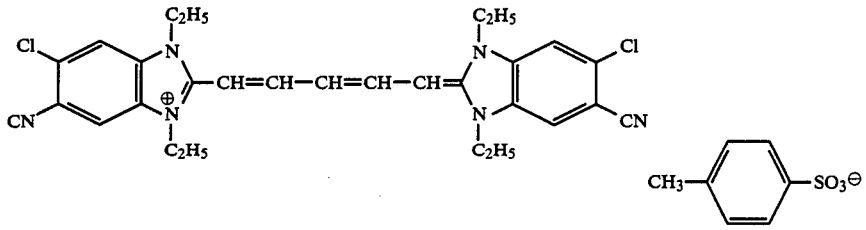

(B)

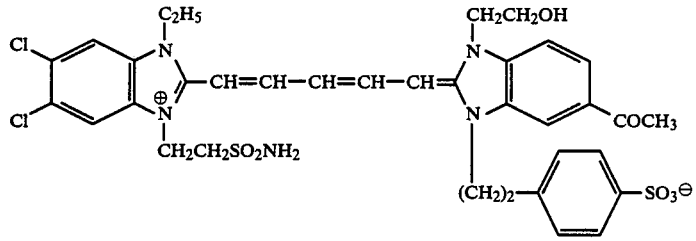

(C)

TABLE 1

| Sample No. | Sensitizing dye and amount thereof (× $10^{-5}$ mole/kg-emulsion) | | Relative red-sensitivity (SR) | Fog | Remark |
|---|---|---|---|---|---|
| 1 | | — | — | 0.04 | |
| 2 | (1) | 4 | 195 | 0.04 | Present invention |
| 3 | " | 8 | 234 | 0.04 | Present invention |
| 4 | " | 16 | 234 | 0.04 | Present invention |
| 5 | " | 32 | 200 | 0.04 | Present invention |
| 6 | (A) | 4 | 85 | 0.04 | Comparison |
| 7 | " | 8 | 100 | 0.04 | " |
| 8 | " | 16 | 81 | 0.06 | " |
| 9 | " | 32 | 43 | 0.09 | " |

TABLE 2

| Sample No. | Sensitizing dye and amount thereof (× $10^{-5}$ mole/kg-emulsion) | | Relative red-sensitivity (SR) | Fog | Remark |
|---|---|---|---|---|---|
| 10 | (17) | 4 | 240 | 0.04 | Present invention |
| 11 | " | 8 | 331 | 0.04 | Present invention |
| 12 | " | 16 | 355 | 0.04 | Present invention |
| 13 | " | 32 | 295 | 0.04 | Present invention |
| 14 | (B) | 2 | 93 | 0.04 | Comparison |
| 15 | " | 4 | 100 | 0.04 | " |
| 16 | " | 8 | 89 | 0.04 | " |
| 17 | " | 16 | 73 | 0.04 | " |

TABLE 3

| Sample No. | Sensitizing dye and amount thereof (× $10^{-5}$ mole/kg-emulsion) | | Relative red-sensitivity (SR) | Fog | Remark |
|---|---|---|---|---|---|
| 18 | (9) | 4 | 186 | 0.04 | Present invention |
| 19 | " | 8 | 234 | 0.04 | Present invention |
| 20 | " | 16 | 257 | 0.04 | Present invention |
| 21 | " | 32 | 204 | 0.05 | Present invention |
| 22 | (C) | 4 | 81 | 0.04 | Comparison |
| 23 | " | 8 | 100 | 0.04 | " |
| 24 | " | 16 | 76 | 0.05 | " |
| 25 | " | 32 | 50 | 0.08 | " |

EXAMPLE 2

A silver halide emulsion comprising pure silver bromide particles of a cubic crystalline form (in which the surface area ratio of the surface [1,0,0] to the total surface area of particles was 92%) and a silver halide emulsion comprising surface area ratio of the surface [1,1,1] to the total surface area of particles was 85%) were prepared. These silver halide emulsions were sulfur-sensitized. The silver halide particles contained in these emulsions had an average particle diameter of 0.9 μm and the content of the silver halide in the emulsion was 0.6 mole/kg (emulsion).

1 kg each of the emulsions was placed in a pot, and a sensitizing dye of the present invention (as shown in the following Table 4) was added thereto and blended and stirred at 40° C. Next, 4-hydroxy-6-methyl-1,3,3a,7-tetrazaindene (in an amount of 0.1 g/kg (emulsion)), sodium 1-hydroxy-3,5-dichlorotriazine (in an amount of 0.1 g/kg (emulsion)) and sodium dodecylbenzenesulfonate (in an amount of 0.1 g/kg (emulsion)) were added to the resulting mixture in this order, and the thus formed coating solution was coated on a polyethylene terephthalate film base to obtain a photographic material.

Each of thus obtained samples was exposed to a light source having a color temperature of 5400° K. for 1 second through the above-mentioned red-color filter (SC-60) and a blue-color filter of Wratten 47B (made by Eastman Kodak Co.) which transmits a blue light having a maximum transmittance at a wavelength of 433 nm.

After the exposure, each sample was developed in a developer having the following composition at 20° C. for 10 minutes. The density of each of the thus developed film samples was measured to obtain the red-filter sensitivity (SR), blue-filter sensitivity (SB) and fog in each sample. The standard point of the optical density for the determination of the sensitivity was a point of "fog+0.2".

COMPOSITION OF DEVELOPER

| | |
|---|---|
| Water | 700 ml |
| Metol | 2.5 g |
| α-Ascorbic acid | 10 g |
| NABOX | 35 g |
| KBr | 1 g |
| Water to make | 1 liter |

Results are set forth in the following Tables 4 and 5. Samples in Table 4 used the former silver halide emulsion of a cubic crystalline form and those in the Table 5 used the latter silver halide emulsion of an octahedral crystalline form. In these Tables, "spectral-sensitivity" designates a relative value of the sensitivity (SR) obtained according to the above-mentioned means on the basis of the sensitivity (SB) in each case. These data mean that, the larger the value is, the higher is the degree of spectral-sensitization.

CHEMICAL STRUCTURAL FORMULA OF COMPARATIVE DYE (D)

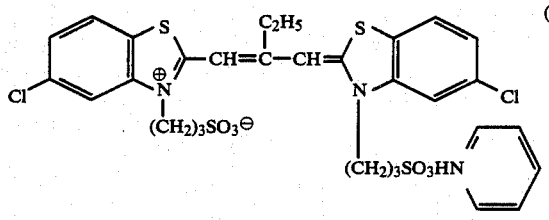

(D)

TABLE 4

| Sample No. | Sensitizing dye and amount thereof (× $10^{-5}$ mole/kg-emulsion) | | Spectral-sensitivity | Fog |
|---|---|---|---|---|
| 26 | (3) | 2 | 162 | 0.04 |
| 27 | " | 4 | 251 | 0.04 |
| 28 | " | 8 | 316 | 0.04 |
| 29 | (7) | 2 | 174 | 0.04 |
| 30 | " | 4 | 240 | 0.04 |
| 31 | " | 8 | 229 | 0.04 |
| 32 | (13) | 2 | 155 | 0.04 |
| 33 | " | 4 | 269 | 0.04 |
| 34 | " | 8 | 346 | 0.04 |
| 35 | (5) | 2 | 166 | 0.04 |
| 36 | " | 4 | 246 | 0.04 |
| 37 | " | 8 | 331 | 0.04 |
| 38 | (D) | 4 | 158 | 0.04 |
| 39 | " | 8 | 224 | 0.04 |
| 40 | " | 16 | 166 | 0.04 |

TABLE 5

| Sample No. | Sensitizing dye and amount thereof (× $10^{-5}$ mole/kg-emulsion) | | Spectral-sensitivity | Fog |
|---|---|---|---|---|
| 41 | (3) | 2 | 23 | 0.04 |
| 42 | " | 4 | 44 | 0.04 |
| 43 | " | 8 | 69 | 0.04 |
| 44 | (7) | 2 | 20 | 0.04 |
| 45 | " | 4 | 35 | 0.04 |
| 46 | " | 8 | 59 | 0.04 |
| 47 | (13) | 2 | 21 | 0.04 |
| 48 | " | 4 | 47 | 0.04 |
| 49 | " | 8 | 76 | 0.04 |
| 50 | (5) | 2 | 30 | 0.04 |
| 51 | " | 4 | 52 | 0.04 |
| 52 | " | 8 | 74 | 0.04 |
| 53 | (D) | 4 | 288 | 0.04 |
| 54 | " | 8 | 316 | 0.04 |
| 55 | " | 16 | 270 | 0.04 |

From the results of Tables 4 and 5, it is understood that the sensitizing dyes of the present invention are especially effective when used in a silver halide emulsion of halogen-particles mainly comprising [1,0,0] surface. On the other hand, sensitizing dye (D) used as a comparative dye is a typical panchromatic dye which is generally well used in a photographic material for camera. When this dye (D) was used, the effect was noted better in the case of a silver halide emulsion containing octahedral particles that in the other case containing cubic particles. However, any noticeable difference is not admitted in the special sensitivity of the two cases, like as the cases where the sensitizing dyes of the present invention were used.

EXAMPLE 3

1 kg each of the same silver halide emulsion as used in Example 1 was put in a pot, and a sensitizing dye (of the present invention or of a comparative dye, as shown in the following Table 6) was added thereto and blended and stirred at 40° C. Next, 4-hydroxy-6-methyl-1,3,3a,7-tetrazaindene (in an amount of 0.3 g/kg (emulsion)), a polyalkylene oxide compound (as shown below, in an amount of 0.7 g/kg (emulsion)), sodium dodecylbenzenesulfonate (in an amount of 2 g/kg (emulsion)), mucochloric acid (in an amount of 0.7 g/kg (emulsion)) and a polymer latex (as described in Japanese Patent Publication No. 5331/70, page 5, Preparation Example-3; in an amount of 38 g/kg (emulsion)) were added to the resulting mixture in this order, and then the thus obtained coating solution was coated on a polyethylene terephthalate film base to obtain a photographic material.

POLYALKYLENE OXIDE COMPOUND USED HEREIN $HO(CH_2CH_2O)_{58}H$

Each of the formed samples was exposed and developed in the same manner as in Example 1, and the density in each sample was measured to obtain the sensitivity and fog thereof. In addition, the film samples were left in a condition of a temperature of 25° C. and a relative humidity of 65% for 3 months, after the coating of the photographic emulsion. Thus preserved samples were exposed and developed in the same manner as above. Thus, the variation on the sensitivity and the fog between fresh samples and preserved samples was observed. Results (relativa values) are given in the following Table 6 (taking the sensitivity of Sample No. 69 as being 100).

CHEMICAL STRUCTURAL FORMULA OF COMPARATIVE DYE (E)

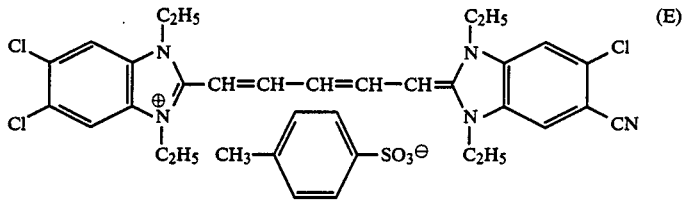

(E)

TABLE 6

| Sample No. | Sensitizing dye and amount thereof ($10^{-5}$ mole/kg-emulsion) | | (a) Fresh sample (immediately after coated) Relative Sensitivity (SR) | Fog | (b) Preserved sample (for 3 months) Relative sensitivity (SR) | Fog | Sensitivity decrease after preservation $\left(\frac{b}{a} \times 100\%\right)$ | Remark |
|---|---|---|---|---|---|---|---|---|
| 56 | (2) | 8 | 437 | 0.04 | 398 | 0.04 | 91 | Present invention |
| 57 | " | 16 | 457 | 0.04 | 421 | 0.04 | 92 | Present invention |
| 58 | " | 32 | 427 | 0.04 | 380 | 0.05 | 89 | Present invention |
| 59 | (6) | 8 | 537 | 0.04 | 499 | 0.04 | 93 | Present invention |
| 60 | " | 16 | 630 | 0.04 | 585 | 0.04 | 93 | Present invention |
| 61 | " | 32 | 513 | 0.04 | 457 | 0.04 | 89 | Present invention |
| 62 | (16) | 8 | 575 | 0.04 | 552 | 0.04 | 96 | Present invention |
| 63 | " | 16 | 630 | 0.04 | 592 | 0.04 | 94 | Present invention |
| 64 | " | 32 | 500 | 0.05 | 455 | 0.05 | 91 | Present invention |
| 65 | (18) | 8 | 390 | 0.04 | 358 | 0.04 | 92 | Present invention |
| 66 | " | 16 | 416 | 0.04 | 366 | 0.05 | 88 | Present invention |
| 67 | " | 32 | 332 | 0.04 | 292 | 0.05 | 88 | Present invention |
| 68 | (E) | 4 | 93 | 0.04 | 66 | 0.05 | 71 | Comparison |
| 69 | " | 8 | 100 | 0.04 | 69 | 0.05 | 69 | Comparison |
| 70 | " | 16 | 83 | 0.05 | 55 | 0.08 | 65 | Comparison |
| 71 | " | 32 | 58 | 0.07 | 30 | 0.13 | 52 | Comparison |

As is apparent from Table 6, the sensitizing dyes of the present invention were extremely higher in sensitivity than the comparative sensitizing dye (E), and, in addition, the decrement of the sensitivity in the present samples, after preserved for 3 months, was less than that in the comparative sample, and the increment of the fog in the present samples, also after preserved for 3 months, was also less than that in the comparative sample.

EXAMPLE 4

In the same manner as in Example 3, photographic materials were prepared, and the samples obtained were exposed as follows:

A negative gray-contact screen (made by Dainippon Screen Co., 150 L/inch) was adhered to each sample, which was then exposed to a laser ray by the use of a neon/helium laser oscillator (GAS LASER GLG 2034, made by Nippon Electric Co.) for $10^{-5}$ second, through a step wedge with steps of 0.1(logE) difference. After the exposure, each sample was developed in an automatic developing processor, using a developer having the following composition, for 100 seconds at 27° C. The sensitivity of each sample was designated in terms of the "relative sensitivity" (taking the sensitivity of Sample No. 91 as being 100), meaning that the blackened area reached 50% in each sample. The stain in the non-exposed part in each sample, after development, was observed, and was evaluated in six grades of from A(best) to F(worst). Results are given in Table 7.

| | |
|---|---|
| Water | 700 ml |
| Hydroquinone | 15 g |
| Adduct of formaldehyde and sodium bisulfite | 50 g |
| Potassium carbonate | 30 g |
| Sodium sulfite | 2.5 g |
| Potassium bromide | 2 g |
| Boric acid | 5 g |
| Sodium hydroxide | 3 g |
| Triethylene glycol | 40 g |
| EDTA.2Na | 1 g |
| Diethanolamine | 15 g |
| Water to make | 1 liter |

CHEMICAL STRUCTURAL FORMULA OF COMPARATIVE SAMPLE (F)

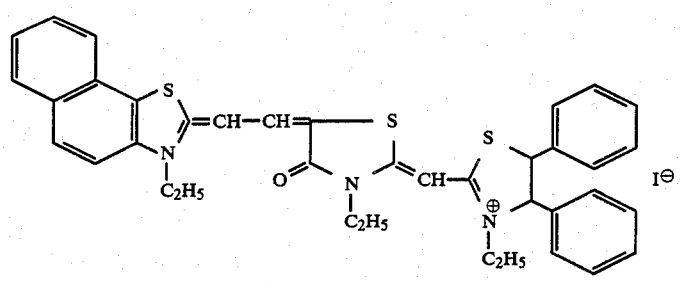

(F)

TABLE 7

| Sample No. | Sensitizing dye and amount thereof (× $10^{-5}$ mole/kg-emulsion) | | Relative sensitivity | Stain | Remark |
|---|---|---|---|---|---|
| 72 | (1) | 4 | 158 | A | Present invention |
| 73 | " | 8 | 214 | A | Present invention |
| 74 | " | 16 | 195 | A | Present invention |
| 75 | (4) | 4 | 135 | B | Present invention |
| 76 | " | 8 | 174 | B | Present invention |
| 77 | " | 16 | 112 | C | Present invention |
| 78 | (5) | 4 | 141 | A | Present invention |
| 79 | " | 8 | 182 | A | Present invention |
| 80 | " | 16 | 126 | B | Present invention |
| 81 | (8) | 4 | 138 | A | Present invention |
| 82 | " | 8 | 190 | A | Present invention |
| 83 | " | 16 | 151 | B | Present invention |
| 84 | (12) | 4 | 166 | A | Present invention |
| 85 | " | 8 | 224 | A | Present invention |
| 86 | " | 16 | 204 | A | Present invention |
| 87 | (14) | 4 | 162 | A | Present invention |
| 88 | " | 8 | 209 | B | Present invention |
| 89 | " | 16 | 186 | B | Present invention |
| 90 | (F) | 4 | 73 | E | Comparison |
| 91 | " | 8 | 100 | E | " |
| 92 | " | 16 | 93 | E | " |
| 93 | (D) | 8 | 36 | F | " |
| 94 | " | 16 | 59 | F | " |
| 95 | " | 32 | 89 | F | " |

Dyes (F) and (D) used in the comparative samples are described in Japanese Patent Application (OPI) No. 151933/81, which are described therein as a sensitizing dye for lith-type photographic materials to be used for formation of dot images by scanner-type exposure with a neon/helium laser. In particular, dye (F) and other dyes having similar chemical structures to dye (F) (for example, dyes of formulae (I) and (II) as described in Japanese Patent Application (OPI) No. 151933/81) are described in Japanese Patent Application (OPI) No. 18726/79 as being most suitable for formation of the photographic materials. In fact, these dyes are excellent dyes having a sensitivity sufficient for practical use, but they are unsatisfactory in the point of the occurrence of stain. In particular, if the photographic material containing the dye is treated for a short period of time in an automatic developing processor, the occurrence of stain in the treated material becomes remarkable. On the contrary, the sensitizing dyes of the present invention are free from the defects occurring in the case of conventional sensitizing dyes, as having a higher sensitivity with less stain. The dot image quality of the photographic material containing the sensitizing dye of the present invention was substantially similar to those containing the comparative dyes, when the dot image of each of a 10%-, 15%- or 90%-blackened area, after being developed for 100 seconds, was observed under a magnification of 100×.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing one or more sensitizing dye represented by formula (I)

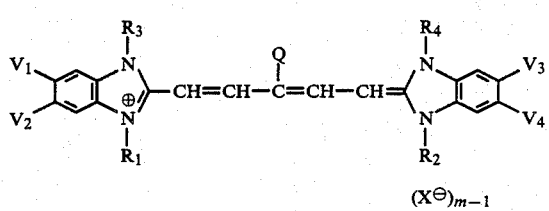

(I)

wherein $R_1$, $R_2$, $R_3$, and $R_4$ each represents an alkyl group, a substituted alkyl group or an alkenyl group;

$V_1$, $V_2$, $V_3$, and $V_4$ each represents a hydrogen atom, a halogen atom, an alkyl group, an alkoxy group, an acyl group, an acyloxy group, an alkoxycarbonyl group, a carboxyl group, an alkylsulfonyl group, a cyano group, or a trifluoromethyl group;

Q represents an alkyl group or an aralkyl group;

$X^{\ominus}$ represents an anion; and m is 1 or 2, provided that when said dye forms an internal salt, m is 1.

2. A silver halide photographic emulsion as in claim 1, containing silver halide particles formed of crystals in which the surface area of the surface [1,0,0] to the total surface area of said particles is 80% or more.

3. A silver halide photographic emulsion as in claim 1, wherein two or more of $V_1$ to $V_4$ represent chlorine atoms and one or more of $V_1$ to $V_4$ represent a cyano group or a trifluoromethyl group.

4. A silver halide photographic emulsion as in claim 1, wherein one or more of $R_1$ and $R_2$ represent a sulfoalkyl group, and one or more of $R_1$ to $R_4$ represent a fluorine-substituted alkyl group.

5. A silver halide photographic emulsion as in claim 2, wherein two or more of $V_1$ to $V_4$ represent chlorine atoms and one or more of $V_1$ to $V_4$ represent a cyano group or a trifluoromethyl group.

6. A silver halide photographic emulsion as in claim 2, wherein one or more of $R_1$ and $R_2$ is a sulfoalkyl group and one or more of $R_1$ to $R_4$ is a fluorine-substituted alkyl group.

7. A silver halide photographic emulsion as in claim 1, wherein Q is a methyl group, an ethyl group, a propyl group, or a benzyl group.

8. A silver halide photographic emulsion as in claim 2, wherein Q is a methyl group, an ethyl group, a propyl group, or a benzyl group.

9. A silver halide photographic emulsion as in claim 1, wherein said sensitizing dye is contained in an amount of from $5\times10^{-7}$ mole to $5\times10^{-3}$ mole per mole of silver halide contained in the emulsion.

10. A silver halide photographic emulsion as in claim 2, wherein said sensitizing dye is contained in an amount of from $5\times10^{-7}$ mole to $5\times10^{-3}$ mole per mole of silver halide contained in the emulsion.

11. A method for forming a photographic image comprising conducting imagewise exposure using a light source having a maximum energy in a wavelength range of from 620 to 670 nm of a photographic material including a silver halide photographic emulsion containing one or more sensitizing dyes represented by formula (I)

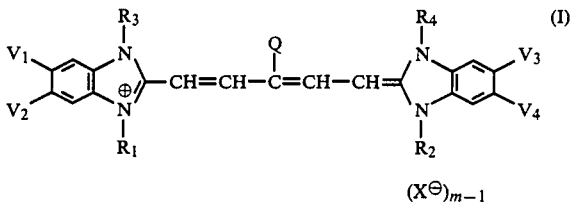

(I)

wherein $R_1$, $R_2$, $R_3$, and $R_4$ each represents an alkyl group, a substituted alkyl group, or an alkenyl group;

$V_1$, $V_2$, $V_3$, and $V_4$ each represents a hydrogen atom, a halogen atom, an alkyl group, an alkoxy group, an acyl group, an acyloxy group, an alkoxycarbonyl group, a carboxyl group, an alkylsulfonyl group, a cyano group, or a trifluoromethyl group;

Q represents an alkyl group or an aralkyl group;

$X^{\ominus}$ represents an anion; and m is 1 or 2, provided that when one of said dye forms an internal salt, m is 1.

12. A method as in claim 11, wherein said light source is a neon/helium laser.

13. A silver halide photographic emulsion as in claim 1, containing silver halide particles formed of crystals in which the surface area of the surface [1,0,0] to the total surface area of said particles is 50% or more.

14. A method as in claim 11, wherein the silver halide photographic emulsion contains silver halide particles formed of crystals in which the surface area of the surface [1,0,0] to the total surface area of said particles is 50% or more.

15. A method as in claim 14, wherein the surface area of the surface [1,0,0] to the total surface area of said particles is 80% or more.

* * * * *